US010245457B2

(12) United States Patent
Ikegami

(10) Patent No.: US 10,245,457 B2
(45) Date of Patent: Apr. 2, 2019

(54) TRAMPOLINE ASSEMBLY HAVING ADJUSTABLE RESILIENT MEMBERS

(71) Applicant: Masato Ikegami, Kitakyushu (JP)

(72) Inventor: Masato Ikegami, Kitakyushu (JP)

( * ) Notice: Subject to any disclaimer, the term of this patent is extended or adjusted under 35 U.S.C. 154(b) by 146 days.

(21) Appl. No.: 15/306,465

(22) PCT Filed: May 5, 2015

(86) PCT No.: PCT/IB2015/001171
§ 371 (c)(1),
(2) Date: Oct. 24, 2016

(87) PCT Pub. No.: WO2015/170181
PCT Pub. Date: Nov. 12, 2015

(65) Prior Publication Data

US 2017/0050064 A1 Feb. 23, 2017

Related U.S. Application Data

(60) Provisional application No. 61/989,040, filed on May 6, 2014.

(51) Int. Cl.
*A63B 5/11* (2006.01)
*A63B 21/02* (2006.01)

(52) U.S. Cl.
CPC ..... *A63B 5/11* (2013.01); *A63B 21/023* (2013.01); *A63B 2225/09* (2013.01); *A63B 2225/30* (2013.01)

(58) Field of Classification Search
CPC ..... A63B 5/00; A63B 5/11; A63B 21/00058; A63B 21/00069; A63B 21/00072;
(Continued)

(56) References Cited

U.S. PATENT DOCUMENTS 1,588,471 A * 6/1926 Bezkorowajnyj ..... F16F 1/122 211/120
1,759,719 A * 5/1930 Spino ..... F16F 1/125 267/74

(Continued)

FOREIGN PATENT DOCUMENTS

DE 2701446 A1 7/1977
WO WO2006055885 A1 5/2006

OTHER PUBLICATIONS

The International Preliminary Report on Patentability for PCT/IB2015/001171, Masato Ikegami, dated Nov. 8, 2016 (related application).

(Continued)

*Primary Examiner* — Gary D Urbiel Goldner
(74) *Attorney, Agent, or Firm* — Roeder & Broder LLP; Steven G. Roeder

(57) ABSTRACT

A trampoline assembly (10) comprises a trampoline bed (12); a trampoline frame (14) that supports the trampoline bed (12); and a plurality of spaced apart, resilient members (16) that are attached to and extend substantially between the trampoline bed (12) and the trampoline frame (14) to maintain the trampoline bed (12) in tension. At least one of the resilient members (16) is an adjustable resilient member (216) that can be selectively adjusted while simultaneously connected to both the trampoline frame (14) and the trampoline bed (12) to selectively adjust the tension of the trampoline bed (12). The adjustable resilient member (216) includes a resilient assembly (218); a first connector (220) that is movably connected to the resilient assembly (218); and a second connector (222) that is movably connected to the resilient assembly (218). The resilient assembly (218) is rotatable in a first rotational direction to increase the tension
(Continued)

of the trampoline bed (12), and in a second rotational direction to decrease the tension of the trampoline bed (12).

15 Claims, 3 Drawing Sheets

(58) Field of Classification Search
CPC ..... A63B 21/00076; A63B 21/00178; A63B 21/00181; A63B 21/00185; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/068; A63B 21/4027; A63B 21/4045; A63B 21/4047; A63B 21/4049; A63B 71/0054; A63B 2071/0063; A63B 2071/0072; A63B 2071/009; A63B 2225/09; A63B 2225/093; A63B 2225/30; Y10T 403/29; Y10T 403/291; Y10T 403/293; Y10T 403/295; Y10T 403/299; F16B 7/06; F16G 11/12
See application file for complete search history.

(56) References Cited

U.S. PATENT DOCUMENTS 2,248,447 A * 7/1941 Wood ..... F16F 1/125 267/136
3,051,519 A * 8/1962 Sudeikis ..... B60D 1/182 280/482
3,356,366 A * 12/1967 Barthel ..... A63B 5/11 182/139
3,466,024 A * 9/1969 Spieth ..... F16F 3/02 267/162
3,751,083 A * 8/1973 Jacobson ..... F16B 7/06 254/100
4,012,967 A * 3/1977 Warren ..... F16C 7/04 403/43
4,162,063 A 7/1979 Nissen et al.
4,452,444 A 6/1984 Schulze
5,336,135 A * 8/1994 Keyvani ..... A63B 5/11 182/137
5,377,556 A * 1/1995 Byrnes ..... F16G 11/12 74/500.5
5,518,233 A * 5/1996 Williams ..... A63B 71/02 248/218.4
5,984,837 A * 11/1999 Weaver ..... A63B 5/11 135/116
7,331,904 B2 * 2/2008 Hall ..... A63B 5/11 482/27
8,561,330 B2 * 10/2013 Siegenthaler ..... B21D 39/00 160/378
8,602,950 B2 * 12/2013 Savarino ..... A63B 21/023 267/179
2006/0116242 A1 6/2006 Publicover
2006/0280549 A1 * 12/2006 Hsieh ..... B63B 25/28 403/43
2013/0196823 A1 * 8/2013 DeBlanco, P.E. ..... A63B 5/11 482/27
2013/0316876 A1 11/2013 Publicover

OTHER PUBLICATIONS

The International Search Report and Written Opinion of the International Searching Authority for PCT/IB2015/001171, Masato Ikegami, dated Oct. 30, 2015 (related application).

* cited by examiner

TRAMPOLINE ASSEMBLY HAVING ADJUSTABLE RESILIENT MEMBERS

RELATED APPLICATION

This application claims priority on U.S. Provisional Application Ser. No. 61/989,040, filed May 6, 2014 and entitled "TRAMPOLINE ASSEMBLY HAVING ADJUSTABLE RESILIENT MEMBERS". As far as permitted, the contents of U.S. Provisional Application Ser. No. 61/989,040 are incorporated herein by reference.

BACKGROUND

Trampolines can be used for recreation, for competitions and for other purposes. A typical trampoline includes a trampoline bed, a trampoline frame, and a plurality of resilient members, e.g., springs, that secure the trampoline bed to the trampoline frame with the trampoline bed in tension. Generally speaking, when a trampoline is used for a long time, the springs will start to stretch out gradually, and the trampoline will not bounce as nicely as before. Stated in another fashion, over time, the tension of the trampoline bed can change due to the springs being stretched when the trampoline is used. Additionally, or alternatively, a user can sometimes accidentally step on the springs while bouncing on the trampoline, and the springs can become badly stretched out. With most current designs, the springs of the trampoline must be replaced to return the trampoline bed to the desired tension.

In addition to recreational usage and competition usage, trampolines are now starting to also be used in the medical field by doctors and physical therapists who use the trampoline for the treatment of patients. In such cases, the patient may benefit from a softer (looser) trampoline bed, instead of a bouncy trampoline bed. Thus, a single trampoline, i.e. a trampoline bed of a single tension, may not be useful for each of a recreational usage, a competition usage and a medical usage.

SUMMARY

The present invention is directed toward a trampoline assembly comprising a trampoline bed; a trampoline frame that supports the trampoline bed; and a plurality of spaced apart, resilient members that are attached to and extend substantially between the trampoline bed and the trampoline frame to maintain the trampoline bed in tension. In various embodiments, at least one of the resilient members is an adjustable resilient member that can be selectively adjusted while simultaneously connected to both the trampoline frame and the trampoline bed to selectively adjust the tension of the trampoline bed.

In certain embodiments, the adjustable resilient member includes a resilient assembly, a first connector that connects the resilient assembly to the trampoline bed, and a second connector that connects the resilient assembly to the trampoline frame. Additionally, in such embodiments, the resilient assembly is rotatable (i) in a first rotational direction relative to the connectors to increase the tension of the trampoline bed, and (ii) in a second rotational direction relative to the connectors to decrease the tension of the trampoline bed.

Additionally, in some embodiments, the resilient assembly includes a spring, a first plug that is fixedly secured to the spring, and a second plug that is fixedly secured to the spring, the second plug being spaced apart from the first plug. In some such embodiments, at least one of the connectors is threaded into one of the plugs. For example, in one embodiment, the first connector is threaded into the first plug, and the second connector is threaded into the second plug. More particularly, the first connector can include a first externally threaded surface, and the second connector can include a second externally threaded surface. Further, threads of the first externally threaded surface can be opposite from threads of the second externally threaded surface. Additionally and/or alternatively, threads of the first externally threaded surface have a different pitch than threads of the second externally threaded surface.

In some embodiments, one of the connectors is swivelably connected to one of the plugs.

Additionally, in certain embodiments, the first connector includes a first hook and the trampoline bed includes a first hole. The first hook fits into the first hole to connect the resilient assembly to the trampoline bed. Further, the first connector can also include a first washer and a first nut that are positioned near a first distal end of the first connector. The first washer and the first nut work in conjunction with one another to inhibit undesired relative movement between the first connector and the resilient assembly.

Further, in some embodiments, the second connector includes a second hook and the trampoline frame includes a second hole. The second hook fits into the second hole to connect the resilient assembly to the trampoline frame. Still further, the second connector can also include a second washer and a second nut that are positioned near a second distal end of the second connector. The second washer and the second nut working in conjunction with one another to inhibit undesired relative movement between the second connector and the resilient assembly.

In one embodiment, all of the plurality of the resilient members are adjustable resilient members.

In another application, the present invention is directed toward a trampoline assembly comprising a trampoline bed; a trampoline frame that supports the trampoline bed; and a plurality of spaced apart, resilient members that are attached to and extend substantially between the trampoline bed and the trampoline frame to maintain the trampoline bed in tension, wherein at least one of the resilient members is an adjustable resilient member that selectively adjusts the tension of the trampoline bed, the adjustable resilient member including (i) a resilient assembly; (ii) a first connector that is movably connected to the resilient assembly, the first connector connecting the resilient assembly to the trampoline bed; and (iii) a second connector that is movably connected to the resilient assembly, the second connector connecting the resilient assembly to the trampoline frame.

As a result of the various designs described in detail herein, the adjustable resilient members can be adjusted to compensate for being stretched over time and/or from damage during use. Further, the adjustable resilient members can be adjusted to provide a softer bed for medical reasons.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
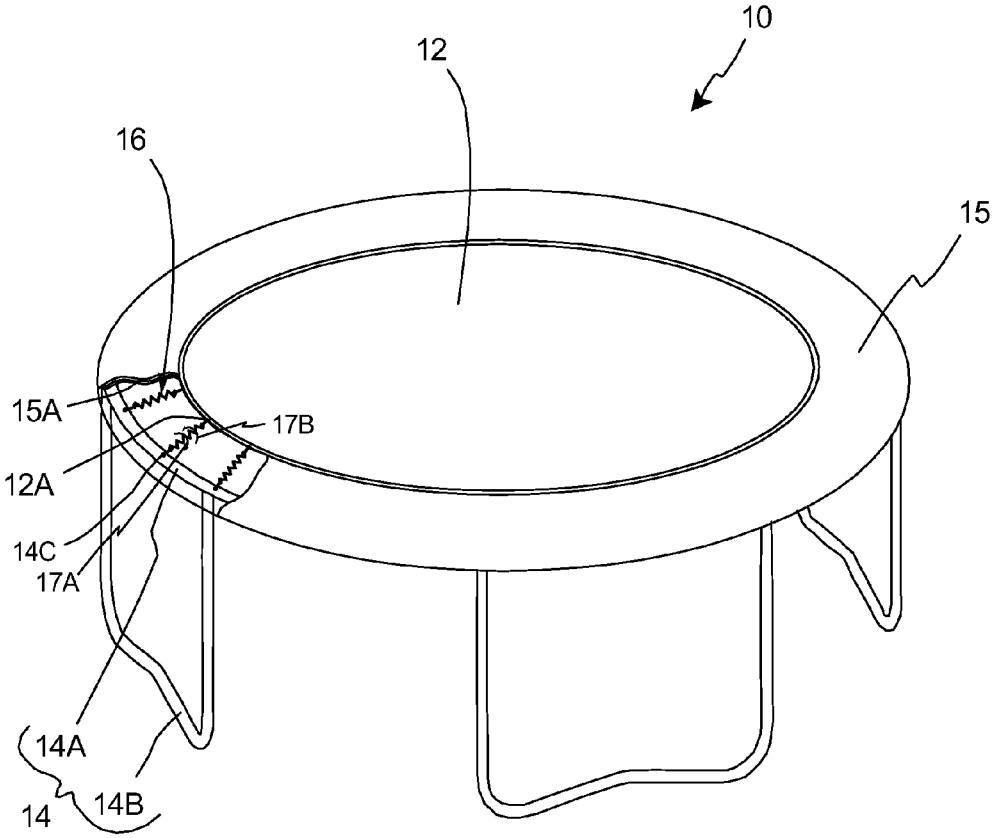
FIG. 1 is a simplified top perspective view of an embodiment of a trampoline assembly, in partial cut-away, including a trampoline bed, a trampoline frame, and a plurality of adjustable resilient members.

FIG. 1 is a simplified top perspective view of an embodiment of a trampoline assembly 10 having features of the present invention. The design of the trampoline assembly 10 can be varied. As illustrated in FIG. 1, in various embodiments, the trampoline assembly 10 includes a trampoline bed 12, a trampoline frame 14, a trampoline cover 15 (partially cut away), and a plurality of spaced apart, resilient members 16 that are attached to and extend substantially between the trampoline bed 12 and the trampoline frame 14 to maintain the trampoline bed 12 in tension. The design of these components can be varied to suit the desired usage of the trampoline assembly 10. Additionally and/or alternatively, the trampoline assembly 10 can be designed with more or fewer components than those specifically listed above. For example, in one non-exclusive alternative embodiment, the trampoline assembly 10 can be designed without the trampoline cover 15.

As an overview, in various embodiments, one or more of the resilient members 16 are adjustable resilient members that can be selectively adjusted to selectively adjust the tension in the trampoline bed 12 in order to achieve a desired tension. For example, in such embodiments, the resilient members 16 can be selectively adjusted to achieve a generally higher (increased) tension for the trampoline bed 12, e.g., when the trampoline assembly 10 is being utilized for recreation and/or competition. Conversely, the resilient members 16 can be selectively adjusted to achieve a generally lower (decreased) tension for the trampoline bed 12, e.g., when the trampoline assembly 10 is being utilized for certain medical treatments. Additionally, the tension for the trampoline bed 12 can be selectively adjusted to compensate for and/or overcome any tension issues that may arise due to prolonged usage of and/or damage to the trampoline assembly 10.

Further, as provided herein, the adjustable resilient members 16 are adjustable while simultaneously directly attached and/or connected to both the trampoline frame 14 and the trampoline bed 12 to selectively adjust the tension of the trampoline bed 12. Stated in another manner, no part of the resilient members 16 needs to be removed and/or disconnected from the trampoline bed 12 and/or the trampoline frame 14 in order to effectively adjust the resilient members 16 to selectively adjust the tension of the trampoline bed 12.

More specifically, in one embodiment, for each adjustable resilient members 16, a portion can be rotated in a first rotational direction 17A (e.g. clockwise) to increase tension and rotated in an opposite, second rotational direction 17B (e.g. counter-clockwise) to decrease tension while still being fixedly attached to both the bed 12 and the frame 14.

As a result thereof, the adjustable resilient members 16 can be selectively adjusted to compensate for being stretched over time and/or to compensate from any damage that may have occurred to the resilient members 16 during use of the trampoline assembly 10. Further, the adjustable resilient members 16 can be adjusted to provide the desired jumping characteristics (desired tension) of the trampoline bed 12. Moreover, such adjustments in the tension of the trampoline bed 12 can be achieved without the need to remove (i.e. detach) and/or replace any of the resilient members 16.

The trampoline bed 12 provides a surface for the user to jump on during use of the trampoline assembly 10. The design of the trampoline bed 12 can be varied depending upon the requirements of the trampoline assembly 10 and/or the trampoline frame 14. As shown in the embodiment illustrated in FIG. 1, the trampoline bed 12 can be substantially circular in shape. For example, in certain non-exclusive alternative embodiments, the trampoline bed 12 can have a diameter of approximately seven (7) feet, nine (9) feet, eleven (11) feet, thirteen (13) feet, or fourteen (14) feet. Alternatively, the trampoline bed 12 can have a diameter that is different than those sizes specifically mentioned above. For example, the trampoline bed 12 can have a diameter of greater than fourteen (14) feet or less than seven (7) feet. Still alternatively, the trampoline bed 12 can be substantially oval-shaped, square-shaped, rectangle-shaped, or some other shape.

Further, the trampoline bed 12 can be formed from various sturdy fabric materials that are designed to withstand the repeated impact from a person using the trampoline assembly 10. For example, the trampoline bed 12 can be formed from a mesh material or other similar material, such as a woven material. Alternatively, the trampoline bed 12 can be formed from materials including heavy canvas, vinyl, or nylon.

In one embodiment, the bed 12 includes a plurality of spaced apart bed apertures 12A (or hole) that are positioned around a perimeter of the bed 12 for attaching the resilient members 16. The bed apertures 12A can be formed directly in bed 12 or by one or more retainers (not shown in FIG. 1) that retain the bed 12. Typically, the number of bed holes 12A is equal to the number of resilient members 16.

The trampoline frame 14 supports the trampoline bed 12 above a support surface (not shown in FIG. 1), e.g., the ground, a floor or other surface. The design of the trampoline frame 14 can be varied depending on the requirements of the trampoline assembly 10. In FIG. 1, the trampoline frame 14 includes a base frame 14A, and a plurality of spaced apart legs 14B that are coupled to the base frame 14A and that support and/or maintain the base frame 14A, and, thus, the trampoline bed 12, above the support surface. The trampoline frame 14 can be formed from various materials such as metal, wood, plastic, composite materials, ceramic, or any other suitably rigid materials. Alternatively, a combination of any of such materials can be used.

In FIG. 1, the base frame 14A is substantially circular in shape. For example, in certain non-exclusive alternative embodiments, the base frame 14A can have a diameter of approximately eight (8) feet, ten (10) feet, twelve (12) feet, fourteen (14) feet, or fifteen (15) feet. Alternatively, the base frame 14A can have a diameter that is different than those sizes specifically mentioned above. For example, the base frame 14A can have a diameter of greater than fifteen (15) feet or less than eight (8) feet. Still alternatively, the base frame 14A can be substantially oval-shaped, square-shaped, rectangle-shaped, or some other shape.

Additionally, in certain embodiments, the base frame 14A can include a plurality of sections that can be secured together to form the base frame 14A. For example, in one embodiment, the base frame 14A is formed from a pair of sections that are each substantially semi-circular in shape. With this modular-type design, shipping and disassembly for storage of the base frame 14A is facilitated. Alternatively, the base frame 14A can be formed as a unitary structure.

In one embodiment, the base frame 14A includes a plurality of spaced apart frame apertures 14C (or hole) that are positioned around a base frame 14A for attaching the resilient members 16. The frame apertures 14C can be formed directly in base frame 14A or by one or more loops (not shown in FIG. 1) that are attached to the base frame 14A. Typically, the number of frame holes 14C is equal to the number of resilient members 16.

The configuration of the legs 14B and the number of legs 14B can be varied to suit the specific requirements of the trampoline assembly 10 and/or the base frame 14A. For example, in the embodiment illustrated in FIG. 1, the trampoline assembly 10 includes four (4) legs 14B (only three (3) are visible in FIG. 1) that are spaced apart around the base frame 14A. In this embodiment, each leg 14B can be somewhat W-shaped for rigidity and strength. Alternatively, the trampoline assembly 10 can be designed to have more than four (4) or less than four (4) legs 14B, and/or the legs 14B can have other than a W-shaped design. For example, in certain embodiments, the legs 14B can have a straight leg design.

Additionally, in some embodiments, the legs 14B are substantially evenly spaced apart around the base frame 14A. Alternatively, the legs 14B can be unevenly spaced apart around the base frame 14A.

The trampoline cover 15 substantially covers at least a portion of the plurality of resilient members 16 and at least a portion of the base frame 14A (a portion of the trampoline cover 15 is cut away in FIG. 1 to illustrate a portion of the base frame 14A and some of the plurality of resilient members 16). The trampoline cover 15 is designed to help protect the user from injury by inhibiting the user from getting hands or feet or other body parts caught or pinched within the plurality of resilient members 16. Additionally, the trampoline cover 15 is designed to help protect the user from injury by inhibiting the user from directly contacting the rigid materials used to form the base frame 14A. The trampoline cover 15 can be made of nylon or other suitable, pliable material. In certain embodiments, a layer of padding 15A can be positioned between the trampoline cover 15 and the plurality of resilient members 16 and/or between the trampoline cover 15 and the base frame 14A.

As noted above and as shown in FIG. 1, the plurality of resilient members 16 are connected to and extend substantially between the trampoline bed 12 and the trampoline frame 14, i.e. the base frame 14A, to maintain the trampoline bed 12 in tension. More particularly, as illustrated, one end of each of the plurality of resilient members 16 can be connected to and/or fit into one of the bed holes 12A in the trampoline bed 12, and the other end of each of the plurality of resilient members 16 can be connected to and/or fit into one of the frame holes 14C in the base frame 14A. Alternatively, the resilient members 16 can be connected to the trampoline bed 12 and/or the base frame 14A in a different manner.

The size and number of the resilient members 16 can be varied to suit the specific requirements and/or to adjust the characteristics of the trampoline assembly 10. For example, in one non-exclusive alternative embodiment, the trampoline assembly 10 can include forty-eight (48) resilient members 16 that are substantially equally spaced apart around a perimeter of the trampoline bed 12. In another non-exclusive alternative embodiment, the trampoline assembly 10 can include ninety (90) resilient members 16 that are equally spaced apart around the perimeter of the trampoline bed 12. Alternatively, the trampoline assembly 10 can include greater than ninety resilient members 16, fewer than forty-eight resilient members 16, or between forty-eight and ninety resilient members 16. Still alternatively, the resilient members 16 can be unequally spaced apart around the perimeter of the trampoline bed 12. It should be noted that only three of the resilient members 16 are illustrated in FIG. 1.

As provided herein, in various embodiments, one or more of the resilient members 16 are adjustable resilient members that can be selectively adjusted to selectively adjust the tension in the trampoline bed 12, i.e. increase the tension and/or decrease the tension in the trampoline bed 12, to achieve the desired tension. For example, in one non-exclusive embodiment, all of the resilient members 16 are adjustable. Additionally, as noted, each of the adjustable resilient members 16 can be selectively adjusted while the resilient member 16 is connected to both the trampoline bed 12 and the base frame 14A.

Figure 2:
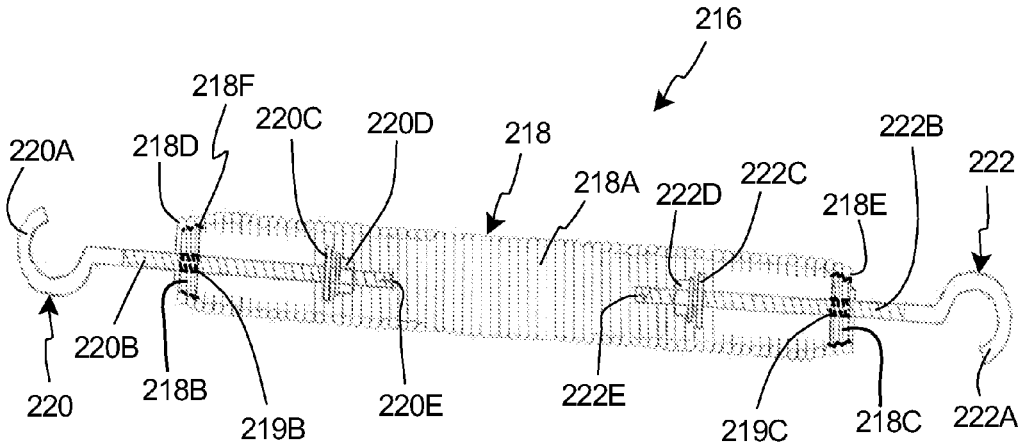
FIG. 2 is a simplified side view, in partial cut-away, of an embodiment of an adjustable resilient member having features of the present invention.

FIG. 2 is a simplified side view, in partial cut-away, of an embodiment of an adjustable resilient member 216 that can be used in the trampoline assembly 10 of FIG. 1. The design of the adjustable resilient member 216 can be varied to suit the requirements of the trampoline assembly 10, the trampoline bed 12 (illustrated in FIG. 1) and/or the trampoline frame 14 (illustrated in FIG. 1). In the embodiment illustrated in FIG. 2, the adjustable resilient member 216 includes a resilient assembly 218, a first connector 220 that is movably, e.g., rotatably, connected to the resilient assembly 218, and a second connector 222 that is movably, e.g., rotatably, connected to the resilient assembly 218. It should be noted that a portion of the resilient assembly 218 is illustrated in cut-away to better expose some of the other components.

In certain configurations, the first connector 220 connects the resilient assembly 218 to the trampoline bed 12, and the second connector 222 connects the resilient assembly 218 to the trampoline frame 14, i.e. to the base frame 14A (illustrated in FIG. 1). Alternatively, the first connector 220 can connect the resilient assembly 218 to the trampoline frame 14, and the second connector 222 can connect the resilient assembly 218 to the trampoline bed 12.

It should be appreciated that the use of the terms "first connector" and "second connector" is merely for purposes of convenience and ease of illustration, and either of the connectors 220, 222 can be referred to as the "first connector" and/or the "second connector".

The design of the resilient assembly 218 can be varied to suit the specific requirements of the trampoline assembly 10. In some embodiments, the resilient assembly 218 includes a spring 218A (or other resilient member), a first plug 218B and a second plug 218C. In this embodiment, the spring 218A can have a diameter of approximately twenty-two (22) millimeters and can be formed from 3.2 millimeter thickness spring steel. Alternatively, the spring 218A can have other dimensions and/or be made of other suitable materials. Additionally, as shown, the spring 218A can include a first spring end 218D and an opposed second spring end 218E.

In certain embodiments, the first plug 218B is fixedly secured to the spring 218A near the first spring end 218D, and the second plug 218C is fixedly secured to the spring 218A near the second spring end 218E. Additionally, as shown, the second plug 218C is spaced apart from the first plug 218B. It should be appreciated that the first plug 218B and the second plug 218C can be fixedly secured to the spring 218A in any suitable manner.

In this embodiment, each of the plugs 218B, 218C defines and includes an internally threaded surface 219B, 219C (illustrated in phantom in FIG. 2), respectively. Further, in certain embodiments, the threads of the internally threaded surface 219B of the first plug 218B are opposite from the threads of the internally threaded surface 219C of the second plug 218C. For example, one of the internally threaded surfaces 219B, 219C can include left-hand threads, while the other internally threaded surface 219B, 219C can include right-hand threads. Additionally and/or alternatively, in some embodiments, the internally threaded surface 219B defined by the first plug 218B can have a different pitch than the internally threaded surface 219C defined by the second plug 218C.

It should be appreciated that the use of the terms "first plug" and "second plug" is merely for purposes of convenience and ease of illustration, and either of the plugs 218B, 218C can be referred to as the "first plug" and/or the "second plug".

Additionally, the first plug 218B and the second plug 218C can be formed from any suitable material. For example, the first plug 218B and the second plug 218C can be formed from one or more of metal, rubber, wood, plastic, composite materials, ceramic, or any other suitable materials.

As noted above, the first connector 220 is movably, e.g., rotatably, connected to the resilient assembly 218. More particularly, in this embodiment, the first connector 220 is movably connected to the first plug 218B.

The design of the first connector 220 can be varied. In one, non-exclusive embodiment, the first connector 220 is shaped somewhat similar to an open hook bolt, and includes (i) a hook 220A that fits into one of the bed holes 12A (illustrated in FIG. 1) of the trampoline bed 12, and (ii) an externally threaded surface 220B with threads that correspond to and are threaded into the first plug 218B. Stated in another manner, in such embodiment, the externally threaded surface 220B of the first connector 220 is configured to threadingly engage the internally threaded surface 219B of the first plug 218B. Alternatively, the first connector 220 can have a different design and/or the first connector 220 can be connected to the trampoline bed 12 in a different manner.

Additionally, as noted above, the second connector 222 is movably, e.g., rotatably, connected to the resilient assembly 218. More particularly, in this embodiment, the second connector 222 is movably connected to the second plug 218C.

The design of the second connector 222 can be varied. Somewhat similar to the first connector 220, in this embodiment, the second connector 222 is also shaped somewhat similar to an open hook bolt, and includes (i) a hook 222A that fits into one of the frame holes 14C (illustrated in FIG. 1) of the trampoline frame 14 (i.e. of the base frame 14A), and (ii) an externally threaded surface 222B with threads that correspond to and are threaded into the second plug 218C. Stated in another manner, in such embodiment, the externally threaded surface 222B of the second connector 222 is configured to threadingly engage the internally threaded surface 219C of the second plug 218C. Alternatively, the second connector 222 can have a different design and/or the second connector 222 can be connected to the base frame 14A in a different manner.

Further, as provided herein, the threads of the externally threaded surface 220B of the first connector 220 can be opposite from the threads of the externally threaded surface 222B of the second connector 222. For example, one of the externally threaded surfaces 220B, 222B can include left-hand threads, while the other externally threaded surface 220B, 222B can include right-hand threads. Additionally and/or alternatively, in some embodiments, the externally threaded surface 220B of the first connector 220 can have a different pitch than the externally threaded surface 222B of the second connector 222.

With this design, rotation of the resilient assembly 218 (i) in the first rotational direction 17A (illustrated in FIG. 1) relative to the connectors 220, 222 causes the connectors 220, 222 to move towards each other (shorten the length of the resilient assembly 218 in a relaxed state) and increase the tension in the trampoline bed 12, and (ii) in the second rotational direction 17B (illustrated in FIG. 1) relative to the connectors 220, 222 causes the connectors 220, 222 to move away from each other (increase the length of the resilient assembly 218 in a relaxed state) and decrease the tension in the trampoline bed 12. Stated in another manner, selective rotation of the resilient assembly 218 relative to the connectors 220, 222, i.e. in the first rotational direction 17A and/or the second rotational direction 17B (e.g. while the connectors 220, 222 are still attached to the frame 14 and bed 12), can move the resilient assembly 218 between a first position, in which the tension in the trampoline bed 12 can be relatively high, and a second position, in which the tension in the trampoline bed 12 is relatively low. Thus, the tension of the trampoline bed 12 can be selectively adjusted by selectively rotating the resilient assembly 218 of any or all of the resilient members 216 relative to the connectors 220, 222. It should be appreciated that the specific tension settings and/or the specific first position and second position of the resilient assembly 218 can be varied as desired depending on the specific requirements of the trampoline assembly 10 and/or the specific uses of the trampoline assembly 10.

Additionally, in certain embodiments, as shown, the first connector 220 includes a washer 220C and a nut 220D that work in conjunction with one another to inhibit undesired relative movement between the first connector 220 and the first plug 218B, e.g., to inhibit over-loosening of the first connector 220. For example, the washer 220C and the nut 220D inhibit the first connector 220 from being threaded out of the first plug 218B. More particularly, the washer 220C and the nut 220D can be positioned to engage one another, e.g., during rotation of the resilient assembly 218 relative to the first connector 220, to inhibit such undesired relative movement between the first connector 220 and the first plug 218B. As such, the washer 220C and the nut 220D can function as a type of locking mechanism that inhibits undesired relative movement between the first connector 220 and the first plug 218B. Further, a distal end 220E of the first connector 220 can be flattened so that the nut 220D will not screw off of the hook bolt.

Similarly, as shown, the second connector 222 can also include a washer 222C and a nut 222D that work in conjunction with one another to inhibit undesired relative movement between the second connector 222 and the second plug 218C, e.g., to inhibit over-loosening of the second connector 222. For example, the washer 222C and the nut 222D inhibit the second connector 222 from being threaded out of the second plug 218C. More particularly, the washer 222C and the nut 222D can be positioned to engage one another, e.g., during rotation of the resilient assembly 218 relative to the second connector 222, to inhibit such undesired relative movement between the second connector 222 and the second plug 218C. As such, the washer 222C and the nut 222D can function as a type of locking mechanism that inhibits undesired relative movement between the second connector 222 and the second plug 218C. Further, a distal end 222E of the second connector 222 can be flattened so that the nut 222D will not screw off of the hook bolt.

In one, non-exclusive embodiment, an outer perimeter of each plug 218B, 218C can include external threading 218F (illustrated with dashed lines). With this design, the first connector 220 can be threaded into the first plug 218B and the second connector 222 can be threaded into the second plug 218C. Subsequently, the washer 220C and nut 220D can be positioned on the respective connector 220, 222. Next, each plug 218B, 218C can be threaded into the respective ends of the spring 218A. Finally, an adhesive or other fastener can be used to fixedly secure the plugs 218B, 218C to the spring 218A.

Figure 3:
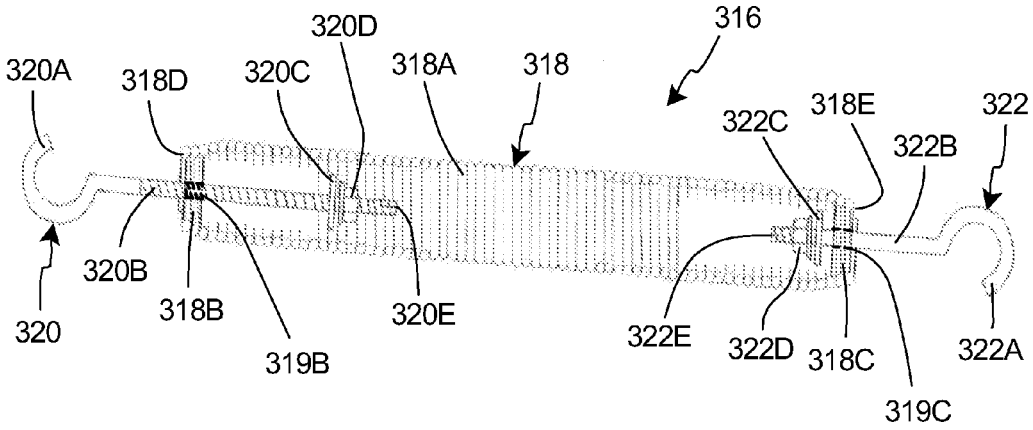
FIG. 3 is a simplified side view, in partial cut-away, of another embodiment of an adjustable resilient member having features of the present invention.

FIG. 3 is a simplified side view, in partial cut-away, of another embodiment of an adjustable resilient member 316 that can be used in the trampoline assembly 10 of FIG. 1. In this embodiment, the adjustable resilient member 316 again includes a resilient assembly 318, a first connector 320 that is movably, e.g., rotatably, connected to the resilient assembly 318, and a second connector 322 that is movably, e.g., swivelably and/or slidably, connected to the resilient assembly 318. It should be noted that a portion of the resilient assembly 318 is illustrated in cut-away to better expose some of the other components.

In certain configurations, the first connector 320 connects the resilient assembly 318 to the trampoline bed 12 (illustrated in FIG. 1), and the second connector 322 connects the resilient assembly 318 to the trampoline frame 14 (illustrated in FIG. 1), i.e. to the base frame 14A (illustrated in FIG. 1). Alternatively, the first connector 320 can connect the resilient assembly 318 to the trampoline frame 14, and the second connector 322 can connect the resilient assembly 318 to the trampoline bed 12.

The design of the resilient assembly 318 can be varied to suit the requirements of the trampoline assembly 10. In some embodiments, the resilient assembly 318 includes a spring 318A, a first plug 318B and a second plug 318C. The spring 318A can include a first spring end 318D and an opposed second spring end 318E, and can be similar to the corresponding component described above in reference to FIG. 2.

In certain embodiments, the first plug 318B is fixedly secured to the spring 318A near the first spring end 318D, and the second plug 318C is fixedly secured to the spring 318A near the second spring end 318E. Additionally, as shown, the second plug 318C is spaced apart from the first plug 318B. It should be appreciated that the first plug 318B and the second plug 318C can be fixedly secured to the spring 318A in any suitable manner.

In this embodiment, the first plug 318B defines an internally threaded surface 319B (illustrated in phantom in FIG. 3), while the second plug 318C defines an aperture 319C (illustrated in phantom in FIG. 3).

As noted above, the first connector 320 is movably, e.g., rotatably, connected to the resilient assembly 318. More particularly, in this embodiment, the first connector 320 is movably connected to the first plug 318B.

The design of the first connector 320 can be varied. For example, the first connector 320 can have a design that is substantially similar to that of the first connector 220 illustrated and described above in relation to FIG. 2. More specifically, in one, non-exclusive embodiment, the first connector 320 is shaped somewhat similar to an open hook bolt, and includes (i) a hook 320A that fits into the bed hole 12A (illustrated in FIG. 1) of the trampoline bed 12, and (ii) an externally threaded surface 320B with threads that correspond to and are threaded into the first plug 318B. Stated in another manner, in such embodiment, the externally threaded surface 320B of the first connector 320 is configured to threadingly engage the internally threaded surface 319B of the first plug 318B.

Additionally, as noted above, the second connector 322 is movably, e.g., swivelably and/or slidably, connected to the resilient assembly 318. More particularly, in this embodiment, the second connector 322 is movably connected to the second plug 318C.

Further, the design of the second connector 322 can be varied. In this embodiment, the second connector 322 is shaped somewhat similar to an open hook bolt (without threads), and includes (i) a hook 322A that fits into the frame hole 14C (illustrated in FIG. 1) of the trampoline frame 14, i.e. of the base frame 14A, and (ii) a smooth shaft 322B that fits into the aperture 319C in the second plug 318C and forms a swivel joint that allows the spring 318A to easily rotate relative to the second connector 322.

It should be appreciated that, in alternative embodiments, the hook 320A of the first connector 320 can be connected to either one of the trampoline bed 12 or the base frame 14A; and the hook 322A of the second connector 322 can be connected to the other of the trampoline bed 12 and the base frame 14A.

With this design, rotation of the resilient assembly 318 (i) in a first rotational direction 17A (illustrated in FIG. 1) relative to the connectors 320, 322 causes the connectors 320, 322 to move towards each other (shorten the length of the resilient assembly 318 in a relaxed state) and increase the tension in the trampoline bed 12, and (ii) in a second rotational direction 17B (illustrated in FIG. 1) relative to the connectors 320, 322 causes the connectors 220, 222 to move away from each other (increase the length of the resilient assembly 218 in a relaxed state) and decrease the tension in the trampoline bed 12. Stated in another manner, selective rotation of the resilient assembly 318 relative to the connectors 320, 322, i.e. in the first rotational direction and/or the second rotational direction, can move the resilient assembly 318 between a first position, in which the tension in the trampoline bed 12 can be relatively high, and a second position, in which the tension in the trampoline bed 12 is relatively low. Thus, the tension of the trampoline bed 12 can be selectively adjusted as desired by selectively rotating the resilient assembly 318 of any or all of resilient members 316 relative to the connectors 320, 322 while the resilient assemblies 318 are attached to both the frame 14 and the bed 12.

In certain embodiments, as shown, the first connector 320 can again include a washer 320C and a nut 320D that work in conjunction with one another to inhibit undesired relative movement between the first connector 320 and the first plug 318B, e.g., to inhibit over-loosening of the first connector 320. More particularly, the washer 320C and the nut 320D can be positioned to engage one another, e.g., during rotation of the resilient assembly 318 relative to the first connector 320, to inhibit such undesired relative movement between the first connector 320 and the first plug 318B. Further, a distal end 320E of the first connector 320 can be flattened so that the nut 320D will not screw off of the hook bolt.

Similarly, the second connector 322 can also include a washer 322C and a nut 322D that work in conjunction with one another to inhibit undesired relative movement between the second connector 322 and the second plug 318C, e.g., to inhibit the second connector 322 from sliding out of the second plug 318C. More particularly, the washer 322C and the nut 322D can be positioned to engage one another, e.g., during rotation of the resilient assembly 318 relative to the second connector 322, to inhibit such undesired relative movement between the second connector 322 and the second plug 318C. Further, a distal end 322E of the second connector 322 can be flattened so that the nut 322D will not screw off of the hook bolt. The washer 322C of the second connector 322 can be made of a slippery material, for example, smooth steel or plastic or include a low friction coating to facilitate the swivel joint.

Figure 4A:
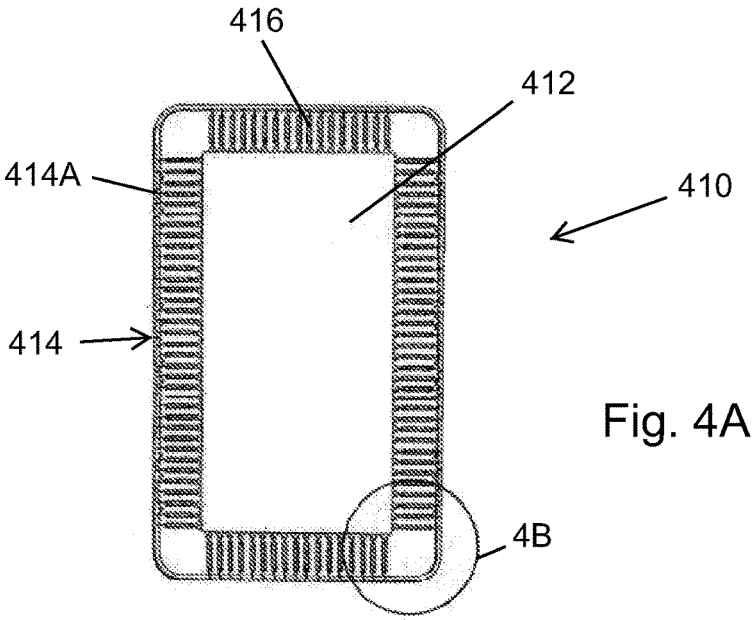
FIG. 4A is a simplified top view of another embodiment of a trampoline assembly.

FIG. 4A is a simplified top view of another embodiment of a trampoline assembly 410, which can include and/or incorporate features of the present invention. In this embodiment, which can be used in trampoline competitions, the trampoline assembly 410 includes a trampoline bed 412 with a generally rectangular shape, a trampoline frame 414 with a generally rectangular shape, and a plurality of resilient members 416 that are attached to and extend substantially between the trampoline bed 412 and to the trampoline frame 414 to maintain the trampoline bed 412 in tension.

The design and/or size of the trampoline bed 412 can be varied depending upon the requirements of the trampoline assembly 10 and/or the trampoline frame 14. In certain non-exclusive alternative embodiments, the trampoline bed 412 can be substantially rectangular in shape and have a length of approximately fourteen (14) feet and a width of approximately seven (7) feet. Alternatively, the dimensions can be greater or less than these amounts. For example, the trampoline bed 412 can have a length that is greater than or less than fourteen feet, and/or the trampoline bed 412 can have a width that is greater than or less than seven feet.

As above, the trampoline frame 414 supports the trampoline bed 412 above a support surface (not shown in FIG. 4A). The design of the trampoline frame 414 can be varied depending on the requirements of the trampoline assembly 410. In this embodiment, the trampoline frame 414 again includes a base frame 414A and a plurality of legs (not shown) that are coupled to the base frame 414A.

In certain, non-exclusive alternative embodiments, the base frame 414A can be substantially rectangular in shape and have a length of approximately fifteen (15) feet and a width of approximately eight (8) feet. Alternatively, the dimensions can be greater or less than these amounts. For example, the base frame 414A can have a length that is greater than or less than fifteen feet, and/or the base frame 414A can have a width that is greater than or less than eight feet.

As noted above, the plurality of resilient members 416 are attached to and extend substantially between the trampoline bed 412 and the trampoline frame 414, i.e. the base frame 414A, to maintain the trampoline bed 412 in tension. In alternative embodiments, the plurality of resilient members 416 can include any desired number of adjustable resilient members such as was illustrated and described herein above in relation to FIG. 2 and/or FIG. 3, and any desired number of standard, prior art, resilient members. For example, in certain such embodiments, at least one of the resilient members 416 is an adjustable resilient member such as was illustrated and described herein above in relation to FIG. 2 and/or FIG. 3. Additionally and/or alternatively, in some such embodiments, all of the resilient members 416 are adjustable resilient members such as was illustrated and described herein above in relation to FIG. 2 and/or FIG. 3. With such design, in the trampoline assembly 410 illustrated in FIG. 4A, the adjustable resilient members 416 can be selectively adjusted to achieve the desired jumping characteristics for trampoline competitions and/or to compensate for stretching of the resilient members 416 during trampoline competitions.

The number of resilient members 416 that connect the trampoline bed 412 to the base frame 414A can be varied. In certain non-exclusive embodiments, the trampoline assembly 410 can include one hundred eighteen (118) resilient members 416 that are spaced around a perimeter of the trampoline bed 412. Alternatively, the trampoline assembly 410 can be designed to have greater than one hundred eighteen (118) or fewer than one hundred eighteen (118) resilient members 416.

Figure 4B:
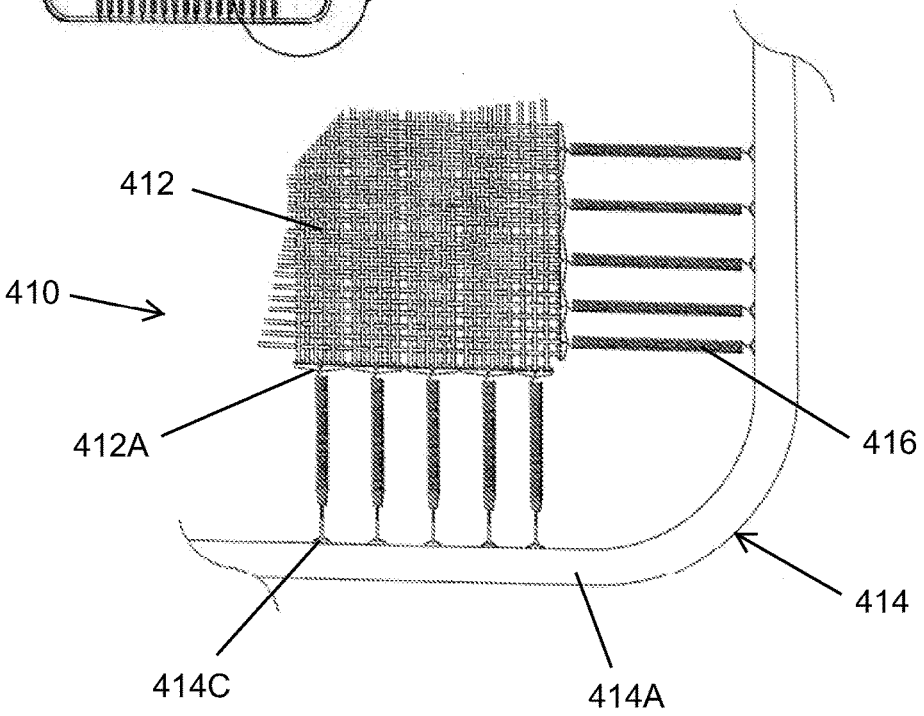
FIG. 4B is an enlarged view of a portion of the trampoline assembly of FIG. 4A, as indicated by circle 4B in FIG. 4A.

FIG. 4B is an enlarged view of a portion of the trampoline assembly 410 of FIG. 4A, as indicated by circle 4B in FIG. 4A. As noted above, in this embodiment, which can be used in trampoline competitions, the plurality of resilient members 416 are attached to the trampoline bed 412 and are also attached to the trampoline frame 414, i.e. to the base frame 414A. More particularly, as illustrated, one end of each of the plurality of resilient members 416 can be connected to and/or fit into a hole 412A in the trampoline bed 412, and the other end of each of the plurality of resilient members 416 can be connected to and/or fit into a hole 414C in the base frame 414A. Alternatively, the resilient members 416 can be connected to the trampoline bed 412 and/or the base frame 414A in a different manner.

While a number of exemplary aspects and embodiments of a trampoline assembly 10 and an adjustable resilient member 216 have been shown and disclosed herein above, those of skill in the art will recognize certain modifications, permutations, additions and sub-combinations thereof. It is therefore intended that the trampoline assembly 10 with the plurality of adjustable resilient members 216 shall be interpreted to include all such modifications, permutations, additions and sub-combinations as are within their true spirit and scope, and no limitations are intended to the details of construction or design herein shown.

What is claimed is:

1. A trampoline assembly comprising:

a trampoline bed;

a trampoline frame that supports the trampoline bed; and a plurality of spaced apart, resilient members that are attached to and extend substantially between the trampoline bed and the trampoline frame to maintain the trampoline bed in tension, wherein at least one of the plurality of spaced apart, resilient members is an adjustable resilient member that can be selectively adjusted while simultaneously connected to both the trampoline frame and the trampoline bed to selectively adjust the tension of the trampoline bed; and wherein the adjustable resilient member includes a resilient assembly, wherein the resilient assembly includes a single spring, a first plug that is fixedly secured to the single spring, and a second plug that is fixedly secured to the single spring, the second plug being spaced apart from the first plug, a first connector that connects the resilient assembly to the trampoline bed, the first connector including a first externally threaded surface that is threaded into the first plug, and a second connector that connects the resilient assembly to the trampoline frame, the second connector including a second externally threaded surface that is threaded into the second plug, wherein threads of the first externally threaded surface are opposite from threads of the second externally threaded surface such that one of the first externally threaded surface and the second externally threaded surface includes right-hand threads and the other of the first externally threaded surface and the second externally threaded surface includes left-hand threads; wherein the resilient assembly is rotatable (i) in a first rotational direction relative to the first connector and the second connector while the adjustable resilient member is simultaneously connected to both the trampoline frame and the trampoline bed to increase the tension of the trampoline bed, and (ii) in a second rotational direction relative to the first connector and the second connector while the adjustable resilient member is simultaneously connected to both the trampoline frame and the trampoline bed to decrease the tension of the trampoline bed; wherein threads of the first externally threaded surface have a differently spaced pitch than threads of the second externally threaded surface.

2. The trampoline assembly of claim 1 wherein the first connector is rotatably connected to the resilient assembly, and wherein the second connector is rotatably connected to the resilient assembly.

3. The trampoline assembly of claim 1 wherein the first connector includes a first hook and the trampoline bed includes a first hole, and wherein the first hook fits into the first hole to connect the resilient assembly to the trampoline bed.

4. The trampoline assembly of claim 1 wherein the first connector includes a first washer and a first nut that are positioned near a first distal end of the first connector, the first washer and the first nut working in conjunction with one another to inhibit undesired relative movement between the first connector and the resilient assembly.

5. The trampoline assembly of claim 1 wherein the second connector includes a second hook and the trampoline frame includes a second hole, and wherein the second hook fits into the second hole to connect the resilient assembly to the trampoline frame.

6. The trampoline assembly of claim 1 wherein the second connector includes a second washer and a second nut that are positioned near a second distal end of the second connector, the second washer and the second nut working in conjunction with one another to inhibit undesired relative movement between the second connector and the resilient assembly.

7. The trampoline assembly of claim 1 wherein all of the plurality of spaced apart, resilient members are adjustable resilient members.

8. A trampoline assembly comprising:

a trampoline bed;

a trampoline frame that supports the trampoline bed; and a plurality of spaced apart, resilient members that are attached to and extend substantially between the trampoline bed and the trampoline frame to maintain the trampoline bed in tension, wherein at least one of the plurality of spaced apart, resilient members is an adjustable resilient member that selectively adjusts the tension of the trampoline bed, the adjustable resilient member including (i) a resilient assembly including a single spring, a first plug that is fixedly secured to the single spring, and a second plug that is fixedly secured to the single spring, the second plug being spaced apart from the first plug; (ii) a first connector that is movably connected to the resilient assembly, the first connector connecting the resilient assembly to the trampoline bed, the first connector being threaded into the first plug, the first connector including a first externally threaded surface; and (iii) a second connector that is movably connected to the resilient assembly, the second connector connecting the resilient assembly to the trampoline frame, the second connector being threaded into the second plug, the second connector including a second externally threaded surface;

wherein threads of the first externally threaded surface are opposite from threads of the second externally threaded surface such that one of the first externally threaded surface and the second externally threaded surface includes right-hand threads, and the other of the first externally threaded surface and the second externally threaded surface includes left-hand threads; and wherein the threads of the first externally threaded surface have a differently spaced pitch than the threads of the second externally threaded surface.

9. The trampoline assembly of claim 8 wherein the resilient assembly is rotatable (i) in a first rotational direction relative to the first connector and the second connector to increase the tension of the trampoline bed, and (ii) in a second rotational direction relative to the first connector and the second connector to decrease the tension of the trampoline bed.

10. The trampoline assembly of claim 8 wherein the adjustable resilient member can be selectively adjusted while simultaneously connected to both the trampoline frame and the trampoline bed to selectively adjust the tension of the trampoline bed.

11. The trampoline assembly of claim 8 wherein the first connector includes a first hook and the trampoline bed includes a first hole, and wherein the first hook fits into the first hole to connect the resilient assembly to the trampoline bed; and wherein the second connector includes a second hook and the trampoline frame includes a second hole, and wherein the second hook fits into the second hole to connect the resilient assembly to the trampoline frame.

12. A trampoline assembly comprising:

a trampoline bed;

a trampoline frame that supports the trampoline bed; and a plurality of spaced apart, resilient members that are attached to and extend substantially between the trampoline bed and the trampoline frame to maintain the trampoline bed in tension, wherein at least one of the plurality of spaced apart, resilient members is an adjustable resilient member that selectively adjusts the tension of the trampoline bed, the adjustable resilient member including (i) a resilient assembly including a spring, a first plug that is fixedly secured to the spring, and a second plug that is fixedly secured to the spring, the second plug being spaced apart from the first plug; (ii) a first connector that is movably connected to the resilient assembly, the first connector connecting the resilient assembly to the trampoline bed, the first connector being threaded into the first plug, the first connector including a first externally threaded surface; and (iii) a second connector that is movably connected to the resilient assembly, the second connector connecting the resilient assembly to the trampoline frame, the second connector being threaded into the second plug, the second connector including a second externally threaded surface; and wherein threads of the first externally threaded surface have a differently spaced pitch than threads of the second externally threaded surface.

13. The trampoline assembly of claim 12 wherein the resilient assembly is rotatable (i) in a first rotational direction relative to the first connector and the second connector to increase the tension of the trampoline bed, and (ii) in a second rotational direction relative to the first connector and the second connector to decrease the tension of the trampoline bed.

14. The trampoline assembly of claim 12 wherein the adjustable resilient member can be selectively adjusted while simultaneously connected to both the trampoline frame and the trampoline bed to selectively adjust the tension of the trampoline bed.

15. The trampoline assembly of claim 12 wherein the first connector includes a first hook and the trampoline bed includes a first hole, and wherein the first hook fits into the first hole to connect the resilient assembly to the trampoline bed; and wherein the second connector includes a second hook and the trampoline frame includes a second hole, and wherein the second hook fits into the second hole to connect the resilient assembly to the trampoline frame.

* * * * *